United States Patent [19]

Steinke

[11] 4,285,307

[45] Aug. 25, 1981

[54] METHOD OF PREHEATING AN INTERNAL COMBUSTION ENGINE OF THE DIESEL, OR SIMILAR, TYPE

[75] Inventor: Leo Steinke, Waiblingen-Hegnach, Fed. Rep. of Germany

[73] Assignee: Robert Bosch GmbH, Stuttgart, Fed. Rep. of Germany

[21] Appl. No.: 46,469

[22] Filed: Jun. 7, 1979

[30] Foreign Application Priority Data

Jul. 6, 1978 [DE] Fed. Rep. of Germany ..... 2829700

[51] Int. Cl.[3] ..... F02P 19/02

[52] U.S. Cl. ..... 123/179 BG; 123/179 H; 123/145 A

[58] Field of Search ..... 123/179 BG, 179 B, 179 H, 123/145 A

[56] References Cited

U.S. PATENT DOCUMENTS

| | | | |
|---|---|---|---|
| 2,606,544 | 8/1952 | Church et al. | 123/145 A |
| 3,490,427 | 1/1970 | Welsh | 123/179 BG |
| 3,551,686 | 12/1970 | Koehler et al. | 123/179 H |
| 4,075,998 | 2/1978 | Krauss et al. | 123/179 BG |
| 4,107,510 | 8/1978 | Tombs et al. | 123/145 A |
| 4,196,712 | 4/1980 | Kawamura et al. | 123/179 BG |

FOREIGN PATENT DOCUMENTS

| | | | |
|---|---|---|---|
| 406283 | 11/1924 | Fed. Rep. of Germany | 123/145 A |
| 2306372 | 8/1974 | Fed. Rep. of Germany | 123/145 A |
| 2549703 | 5/1977 | Fed. Rep. of Germany | 123/145 A |
| 47-30068 | 8/1972 | Japan | 123/179 H |

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

To rapidly heat glow plugs having positive temperature coefficient characteristics, or glow plugs in circuit with a positive temperature coefficient resistor, without overloading connecting relay contacts, a current limiting resistor is placed in circuit with the glow plugs upon first connection thereof to a supply source. After elapse of a first time interval of about 0.1 to 0.3, maximally 1 second, a second switch is controlled to short-circuit the current limiting resistor to permit full voltage to be applied to the glow plugs for rapid heating thereof, during a second time interval, for example between about 2 to 6 seconds, the positive temperature characteristics of the circuit self-limiting current through the resistors to thereby protect circuit switches and relay contacts.

20 Claims, 2 Drawing Figures

Figure 1:
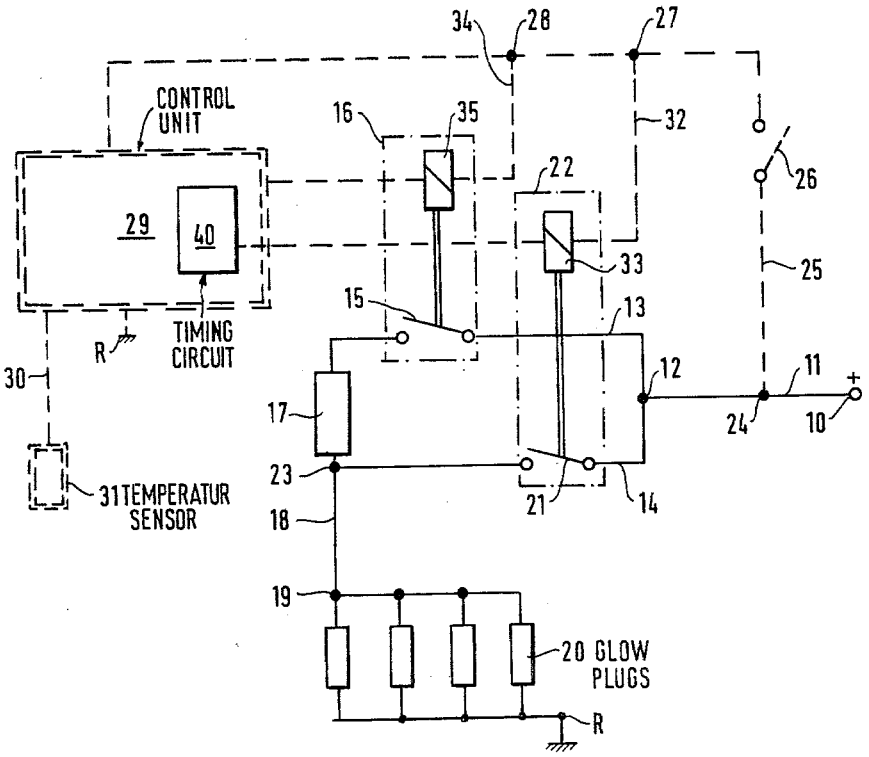

METHOD OF PREHEATING AN INTERNAL COMBUSTION ENGINE OF THE DIESEL, OR SIMILAR, TYPE

The present invention relates to a method of preheating a Diesel engine, or other internal combustion engine of similar type, requiring preheating, and more particularly to a method of so connecting and operating glow plugs in such an engine that the preheating time is reduced.

BACKGROUND AND PRIOR ART

Diesel engines and other internal combustion engines which require preheating frequently have glow plugs fitted into the cylinder. An arrangement to preheat such engines which, for convenience, will be referred to collectively as Diesel engines, is described in German Patent Publication DE-AS No. 1120 813. That system is directed to maintenance of the preheating temperature of the glow plug itself when air and fuel are supplied to the engine. Increasing use of Diesel engines for automotive vehicles required shorter and shorter times to permit starting of the engine, even under cold ambient temperatures. Glow plugs which use resistance wires with positive temperature coefficient characteristics are of particular interest for use with such engines—see, for example, German Patent Publication DE-AS No. 1 526 775, German Patent Disclosure Document DE-OS No. 1 426 173 and German Pat. No. 1 176 929. Systems and elements disclosed in these patent publications could not, satisfactorily, be installed in known circuit arrangements. The high turn-on current peaks resulted in damage to switching elements, particularly due to switch or contact chatter, so that switching contacts were endangered and subject to the possibility of welding together. Due to the high turn-on current peaks it was not possible to completely load the glow plugs to their maximum possible current carrying capacity.

THE INVENTION

It is an object to provide a method of preheating glow plugs, and more particularly glow plugs of the positive temperature coefficient (PTC) type, in which the glow plugs can be subjected to carry current at their maximum continuous rating while still not overloading the switch contacts when first connecting the glow plugs while they are still cold, that is, have a lower resistance than when heated.

Briefly, in accordance with a preferred feature of the invention, a current limiting resistor is placed in circuit with the glow plugs when first connected; after some time, as determined by a timing circuit, the current limiting resistor is short circuited. The switching-ON current, which is to be carried by switching contacts, which arises when the glow plugs are still cold, is limited by the current limiting resistor placed in series therewith. A typical time for this first period of heating the glow plugs is about 1 second or less, for example as short as 1/10 to $\frac{1}{3}$ second. Full current is then passed through the glow plugs for a second period of time, for example for several seconds, which will rapidly heat the glow plugs to carry rated current, which decreases as the glow plugs become hotter. This second time period may be between 2 to 6 seconds and can be determined by a temperature sensor arranged e.g. in the cooling system of the Diesel engine. Preferably, the glow plugs have low heat capacity. If the glow plugs, themselves, are not of the positive temperature coefficient (PTC) type, then a resistor having such PTC characteristic can be connected in series therewith and form part of the glow plug circuit. The system includes a further feature, namely of opening the short-circuiting switch after the second time period of from between 2–6 seconds has elapsed, to let a "hold warm" or maintenance current flow to the glow plug through the current limiting resistor. This "hold warm" period preferably is limited in time by a timing circuit; if the engine is not started, that is, if the starter switch is not operated during that further time period, which may extend, for example, to about 15 seconds, then the entire circuit is interrupted and and an entirely new starting cycle has to be initiated.

The method of preheating the glow plugs first through a current limiting resistor and then directly, while using the PTC characteristics thereof, or of a series connected resistor, has the advantage that the relays and switches connected in series with the glow plugs and passing current therethrough are protected, since the current carried by the relay contact is substantially decreased. Thus, the relay contacts are no longer endangered by welding together, pitting, or other damage which may result due to excessive current flow or relay chatter; yet, both the preheat time can be decreased, and current peaks are likewise avoided.

Figure 2:
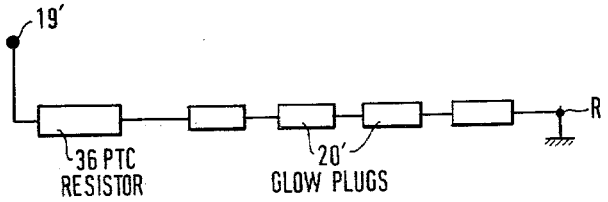

Drawings, illustrating circuits with which the method can be used:

FIG. 1 is a general circuit diagram of the arrangement in which the method is used; it shows the general switching arrangement in connection with four parallel connected glow plugs. Systems, elements and connections which are merely illustrative and desirable for a general understanding of the invention are shown in broken lines; those circuit connections which form part of the invention are shown in full lines; and FIG. 2 is a fragmentary diagram illustrating the arrangement with series connected glow plugs and further with glow plugs which do not have PTC characteristics.

A battery, not shown, is connected between terminals 10 and R, FIG. 1. Terminal 10 is the positive terminal, R the reference, chassis or ground terminal. Terminal 10 is connected by line 11 to a junction 12 from which two branches 13, 14 extend. Branch 13 is connected through a normally open (NO) switch 15 of a first power switching relay 16, having a relay coil 35, and then through a resistor 17 to a junction 23. Junction 23 is connected by line 18 to a junction 19 from which a plurality of glow plugs, for example four glow plugs 20, extend, connected in parallel, the other terminal of which is connected to ground or chassis or reference terminal R. The glow plugs 20 are known types of glow plugs which include a heater element located in a ceramic packing and retained in a metal sleeve. The heater element has PTC characteristic.

Junction 12 is also connected to line 14 which is connected through normally open (NO) switch terminal 21 of a second power relay 22, the other terminal of which is connected to junction 23.

A junction 24 is connected in line 11, leading through line 25 to a "start" switch 26 which, typically, is to be operator-controlled. Line 25 then extends to a junction 27, a junction 28, and to a control unit 29. Control unit 29 provides a timing control for timing the various connecting steps or connecting sequences used in the method, and may, therefore, contain a plurality of R/C timing circuits, schematically indicated as block 40. The timing circuits themselves do not, directly, form the subject matter of the present invention and can be constructed in accordance with any well known resistor/-capacitor circuits. The control unit 29 preferably is connected by line 30 with a temperature sensor 31. Temperature sensor 31 may be inserted, for example, in the cooling system, for example within the cooling liquid of the internal combustion engine with which the system and method is to be used. The timing of the various timing circuits 40 can thereby be influenced by the temperature of the engine, or its cooling water—in dependence on the position of the temperature sensor 31—to influence or determine the heating intervals, and other timing intervals.

Junction 27 and control line 25 are connected through line 32 and through the control winding 33 of the second power relay 22 to the control unit 29 and, also, to the timing circuit thereof. A line 34, extending from junction 28, is connected through the control coils 35 of the first power relay 16 to the control unit 29. The circuit is closed by a connection from the control unit to reference R.

Operation: Upon closing of switch 26, current flows as follows: Terminal 10—line 11—junction 24—line 25—switch 26 (closed)—junction 27—junction 28—energizing control unit 29; junction 28—line 34—coil 35 of power relay 16—control unit 29—chassis R. Due to energization of coil 35, the switch 15 will close. Thus, a first heating circuit is established for glow plugs 20: Junction 10—line 11—junction 24—junction 12—line 13—switch 15 (closed)—current limiting resistor 17—junction 23—line 18—junction 19—glow plugs 20 (in parallel)—chassis R. The value of resistor 17 is so selected that it will suppress the switch-on peak. This is particularly important since the glow plugs 20, with PTC characteristic, have a relatively low internal cold resistance. The resistor 17, therefore, should limit the current through the glow plugs 20 to the rated continuous current value, suppressing the switch-on peak.

Method in accordance with the invention: The limited current flowing upon connection of switch 26, that is, limited by the value of resistor 17, is increased by short-circuiting the resistor 17 after a first time period $t_1$ of between about 1/10 to 3/10 second, preferably about 2/10 second. The resistor 17 is short-circuited by energizing the second power relay 22, that is, by providing a closed circuit from timing circuit 40 through control coil 33 of second power relay 22 and line 32 to junction 27, which is energized due to the closing of switch 26. Upon energization of coil 33, switch 21 will close, thus short-circuiting the resistor 17 and providing a direct current path from the terminal 10 to junctions 23 and 19 and hence to the glow plugs 20.

Glow plugs 20 are so dimensioned that, after first having current flowing therethrough, they will heat rapidly. Full voltage is then applied which causes still more rapid heating. To provide for rapid heating of the glow plugs, they preferably should be constructed to have as low as heat capacity as possible. The high current flowing through the glow plugs upon direct connection should not extend, preferably, beyond 6 seconds. Usually, however, and influenced by the temperature sensors 31 and the control unit 29, a shorter time span $t_2$ for full current flow will be selected. The time period $t_2$, during which full current flows, preferably is in the order of between 2 to 6 seconds. After the time period $t_2$, as determined by the control unit 29—influenced, for example, by the temperature of sensor 31—has elapsed, current through relay coil 33 of the second power relay 22 is interrupted. Thus, the NO switch 21 will open. Current is then supplied to the glow plugs 20 again through the resistor 17. The resistance of the glow plugs 20 has already increased, however, so that the current will be less than when they were first connected. The current is, however, sufficient to maintain the glow plugs at a temperature adequate for starting. The current is maintained at that level for a third time period $t_3$ which permits starting of the engine—for example for about 15 seconds. If, within that third time period $t_3$, the engine is not started, then the control unit 29 will disconnect the entire circuit by interrupting current supply to coil 35 of the first power relay 16, which will cause opening of the NO switch 15 thereof and thus interrupt all current to the glow plugs 20. An entirely new cycle of starting must then be initiated.

The drawing has been simplified to explain only those elements which are required for an understanding of the invention. In a complete automotive system, additional control lamps indicating readiness to start, termination of the preheating period, and the like, will be provided; further, elements such as starter motors and the like have been omitted. Control lamps can be included in circuit with the relay coils 33, 35; for example, an indicator lamp connected in parallel to the relay coil 33 and connected to the left side (FIG. 1) thereof and to reference will indicate, by lighting, when the relay 33 is deenergized. The brief flash during the initial connection will indicate readiness of the system for starting.

Current is connected to the plugs 20 in steps, by sequentially energizing relays 16 and 22. Since the current flowing through the terminals of the switch 15 forming part of relay 16 is limited by the resistor 17, and the current switched by the relay 22 is already at the normal operating level of the glow plugs 20, the terminals of the switches 15, 21 are protected against excessive current, and hence against welding and other possible damage thereto; simultaneously, glow plugs 20 are protected against high current switch-ON peaks upon initial connection.

Some glow plugs have an exposed heating wire. Glow plugs 20' (FIG. 2) are illustrated to be of that type. The method as described in connection with FIG. 1 can be used equally for those glow plugs. Junction 19' (FIG. 2) is then connected instead of junction 19, FIG. 1. So far, no heating wire for plugs 20' is known which can accept the extreme stresses placed thereon in the combustion chamber of an internal combustion chamber and, simultaneously, has PTC characteristic. In order to obtain the same effect, a resistor 36 with PTC characteristic is therefore connected in series with the plugs 20'. Resistor 36 can be located outside of the cylinder of the engine, and has the same effect, with respect to its resistance, as the heater elements within the glow plugs 20 (FIG. 1) themselves.

The time period $t_1$ between closing of the switch terminal 15 in line 13 and the closing of switch terminal 21 in line 14 is usually less, and often much less than 1 second, preferably between 0.1 and 0.3 second. The time period $t_2$, between the closing and opening of the switch 21 in line 14, is generally between 2 and 6 seconds.

The system and method as described can also be used with flame-type glow plugs.

In a system arranged for 12 V supply voltage, and having four glow plugs of the type according to DE-OS No. 1426173 (FIG. 3) connected as in FIG. 1, a resistor 17 of 100 milliohms is suitable. For glow plugs of type 20' (FIG. 2) connected in series as shown, a resistor 36 having a cold resistance of 20 milliohms and a hot resistance of 60 milliohms after 10 seconds is suitable. Low heat capacity plugs are plugs of the type having a temperature rise rate of between 200° and 300° C./second.

I claim:

1. In an internal combustion engine requiring preheating for example a Diesel engine, having electrical glow plugs (20, 20'), an electrical circuit (10, 18, 19, 19', 20, 20', 36, R) including said glow plugs, said circuit having positive temperature coefficient of resistance characteristics, and including a current limiting resistor (17) and a controlled first switch (15) serially connected with the glow plugs to control current flow and its intensity thereto, and a controlled second switch (21) connected across the current limiting resistor to selectively short-circuit said resistor upon closing of said second switch, the method of preheating which comprises, in accordance with the invention, controlling said first switch (15) to close and thereby energize the electrical circuit and hence pass limited current through the glow plugs (20, 21') and the current limiting resistor (17) while said second switch (21) is in open condition;

then, when a first predetermined time period ($t_1$) of less than 1 second after energization of the glow plugs has elapsed controlling said second switch (21) to short-circuit the current limiting resistor (17);

and passing current through said electrical circuit directly to the glow plugs for a second predetermined time period ($t_2$) of at least 2 seconds to rapidly heat the glow plugs.

2. Method according to claim 1, wherein said first predetermined time period ($t_1$) is between approximately 0.1 and 0.3 second.

3. Method according to claim 1, wherein said second predetermined time period ($t_2$) is between about 2 to 6 seconds.

4. Method according to claim 3, wherein said first predetermined time period ($t_1$) is between approximately 0.1 and 0.3 second.

5. Method according to claim 1 or 2 or 3 or 4, further including the step of controlling opening of the controlled second switch (21) after elapse of said second predetermined time period ($t_2$) while maintaining said first switch (15) in closed condition to pass current through said circuit at a level which will be limited by the inherent positive temperature characteristic of the circuit and by the inclusion of the current limiting resistor (17) therein.

6. Method according to claim 1, further including the step of sensing temperature of the engine and controlling the elapsed time within said second predetermined time period ($t_2$) in accordance with said sensed temperature.

7. Method according to claim 1, wherein the glow plugs in said circuit are of the positive temperature coefficient resistance characteristic type and thereby impart said characteristic to the electrical circuit.

8. Method according to claim 1, wherein said circuit includes a resistor (36) having positive temperature resistance characteristics in series with the glow plugs and thereby imparts said characteristic to the electrical circuit.

9. Method according to claim 1, wherein the glow plugs in said circuit are of the low heat capacity type to result in rapid heating of the glow plugs during the steps of controlling said first switch (15) to close and the subsequent step of controlling the second switch (21) to close.

10. Method according to claim 4, further including the step of controlling opening of the second switch (21) after elapse of said second predetermined time period ($t_2$) while maintaining said first switch (15) in closed condition to pass current through said circuit at a level which will be limited by the inherent positive temperature characteristic of the circuit and by the inclusion of the current limiting resistor (17) therein;

and the step of sensing the temperature of the engine and controlling the elapsed time within said second predetermined time period ($t_2$) in accordance with said sensed temperature.

11. A Diesel engine glow plug preheating system comprising an electrical circuit (10, 18, 19, 19'R, 20, 20', 36) including in series circuit arrangement;

at least one glow plug (20) having positive temperature coefficient of resistance (PCT) characteristic, a current limiting resistor (17), and a controlled first control switch (15) serially connected with the at least one glow plug and the current limiting resistor to control current flow to said series circuit arrangement;

a second control switch (21) connected across the current limiting resistor to selectively short circuit said current limiting resistor upon closing of said second control switch, said second control switch having normally open terminals;

and a timing control unit (29, 40) connected to and controlling operation of said second control switch (21) to control said second control switch to close the normally open (NO) terminals after elapse of a first time period ($t_1$) in the order of less than one second and thereby short circuit said current limiting resistor (17), said timing control unit (29, 40) being additionally connected and controlling operation of said controlled first control switch (15) to close for energization of the glow plugs and to remain closed at least for a second time period ($t_2$) of at least two seconds and subsequent to said first time period ($t_1$) to rapidly heat the glow plugs.

12. System according to claim 11 wherein said first time period ($t_1$) is between approximately 0.1 and 0.3 second.

13. System according to claim 11 wherein said second time period ($t_2$) is between about 2 to 6 seconds.

14. System according to claim 13 wherein said first time period ($t_1$) is between approximately 0.1 and 0.3 second.

15. System according to claim 11 wherein said timing control unit, after elapse of said second time period ($t_2$) additionally controls said second control switch (21) to open said normally open (NO) terminals while maintaining said first control switch (15) in closed condition for a third time period ($t_3$) to pass current through said electrical circuit at a level which will be limited by the inherent positive temperature characteristic of the circuit and by the inclusion of the resistance of the current limiting resistor (17) therein.

16. System according to claim 11 further comprising temperature sensing means (31) sensing temperature of the engine, connected to and controlling operation of said timing control unit (29, 40) and controlling said second time period ($t_2$) in accordance with said sensed temperature.

17. System according to claim 11 wherein a plurality of glow plugs are provided, and said glow plugs (20) have positive temperature coefficient of resistance characteristics.

18. System according to claim 11 further comprising a positive temperature resistance characteristic resistor (36) serially connected with said at least one glow plug to impart positive temperature coefficient of resistance characteristics thereto.

19. System according to claim 11 wherein a plurality of glow plugs (20) are provided, and said glow plugs are of the low heat capacity type to result in rapid heating of the glow plugs during said first and second control time periods.

20. System according to claim 16 and wherein said first time period ($t_1$) is between approximately 0.1 and 0.3 second;

said second time period ($t_2$) is between about two to six second;

and wherein said timing control unit additionally controls said second switch (21) after elapse of said second time period ($t_2$) to revert to open condition, while maintaining the first control switch (15) in closed condition to pass current through said circuit at a level which will be limited by the inherent positive temperature characteristic of the circuit and by the inclusion of the resistance of the current limiting resistor (17) therein.

* * * * *